US007930999B2

(12) United States Patent
Hada et al.

(10) Patent No.: US 7,930,999 B2
(45) Date of Patent: Apr. 26, 2011

(54) COOLING WATER PASSAGE STRUCTURE OF INTERNAL COMBUSTION ENGINES

(75) Inventors: Masatoshi Hada, Nagoya (JP); Satoshi Murata, Yokohama (JP); Naoyuki Satou, Akishima (JP)

(73) Assignees: Nissan Motor Co., Ltd., Yokohama-shi, Kanagawa-ken (JP); Renault S.A.S., Boulogne Billancourt (FR)

( * ) Notice: Subject to any disclaimer, the term of this patent is extended or adjusted under 35 U.S.C. 154(b) by 842 days.

(21) Appl. No.: 10/961,394

(22) Filed: Oct. 12, 2004

(65) Prior Publication Data

US 2005/0079067 A1 Apr. 14, 2005

(30) Foreign Application Priority Data

Oct. 10, 2003 (JP) ..... 2003-352842

(51) Int. Cl.
*F02F 1/02* (2006.01)

(52) U.S. Cl. ..... 123/41.71; 123/41.72; 123/41.73

(58) Field of Classification Search .... 123/41.71–41.79; *F02F 1/02*
See application file for complete search history.

(56) References Cited

U.S. PATENT DOCUMENTS 2,456,951 A * 12/1948 Klotsch ..... 123/41.74
4,419,970 A * 12/1983 Shaw ..... 123/41.74
4,741,293 A * 5/1988 Itoh et al. ..... 123/41.79
7,107,954 B2 * 9/2006 Yamashita et al. ..... 123/142.5 R
2003/0056738 A1 3/2003 Aketa et al.

FOREIGN PATENT DOCUMENTS

| | | |
|---|---|---|
| DE | 3425797 | 1/1986 |
| EP | 1052394 | 11/2000 |
| JP | 4-113367 | 10/1992 |
| JP | 5071416 | 3/1993 |
| JP | 11280538 | 10/1999 |
| JP | 2002-339749 | 11/2002 |
| JP | 2002364360 | 12/2002 |

* cited by examiner

*Primary Examiner* — Michael Cuff
*Assistant Examiner* — Keith Coleman
(74) *Attorney, Agent, or Firm* — Dennison, Schultz & MacDonald

(57) ABSTRACT

A cooling water passage structure of internal combustion engines is provided which can contribute to a scale-down of the external form of the engine and also can prevent deformation of the cylinder bores. The cooling water passage structure comprises a water jacket for the flow of cooling water provided on the peripheries of a plurality of cylinder bores; and a lateral suction passage 9*a*, 9*b* integrally formed with a side wall of a cylinder block 2 having bolt holes formed for fastening a cylinder head 3. The lateral suction passage runs through by the cylinder bores at a height in the vicinity of the water jacket bottom and is arranged on the outside of, and perpendicular to the bolt holes. On the rear surface of the cylinder head 3 is mounted a water passage block 15 and on the front end part of the cylinder block 2 is provided a water pump housing 10.

2 Claims, 5 Drawing Sheets

COOLING WATER PASSAGE STRUCTURE OF INTERNAL COMBUSTION ENGINES

FIELD OF THE INVENTION

The present invention relates to a structure of a cooling water passage in an internal combustion engine for automobiles or for industrial machines.

BACKGROUND OF THE INVENTION

In a case of the prior art, as disclosed in the following patent document, there is a structural arrangement where on a side wall of a cylinder block is provided a by-pass passage to introduce the cooling water discharged from a water jacket into a water pump.

Unexamined Patent Publication No. 2002-364360

In the above-described known structure, it is necessary to provide the by-pass passage on the outside of reinforcement ribs formed over the side wall of the cylinder block, so that the projecting size out of the side wall comes to be larger corresponding to the by-pass passage. This means a drawback that an external form of an internal combustion engine comes to be larger, so that the capability of the engine for installation on vehicles is reduced.

Further, when a cylinder head is fastened through bolts to a cylinder block, according to a large fastening force of the bolts against the cylinder block there is generated a large working force to pull up the cylinder block in the direction to the cylinder head. Because of this working force, there arises the externally oriented deformation in the vicinity of the bottom of the water jacket formed on the periphery of cylinder bores, so that inferior roundness of the cylinder bores occurs. As a result, there are such problems as increase of the frictional loss between the cylinder bores and the pistons sliding therein, output power decrease of internal combustion engines, inferior sealing performance of piston rings, increase of blow-bye gas, etc.

In view of the above-described conventional problems, it is an object of the present invention to provide a cooling water passage structure of internal combustion engines which enables the internal combustion engine to be reduced in weight without enlarging the external form thereof and enables the deformation of the cylinder bore to be suppressed.

According to an aspect of the present invention, there is provided a cooling water passage structure of internal combustion engines, comprising: a water jacket for flowing of cooling water provided on the peripheries of a plurality of cylinder bores; and a lateral suction passage integrally formed with a side wall of a cylinder block having bolt holes formed for fastening a cylinder head, the lateral suction passage running through by the cylinder bores at a height in the vicinity of the water jacket bottom, and the suction lateral passage arranged on the outside of and perpendicular to the bolt holes.

Thus, the suction lateral passage is formed integrally on the side wall of the cylinder block and outside of the bolt holes, and the suction lateral passage runs through by the plurality of cylinder bores at a height in the vicinity of the water jacket bottom, such that it is arranged perpendicular to the bolt holes. In this way, by disposing the suction lateral passage perpendicular to the bolt tightening direction at the height in the vicinity of the bottom of the water jacket which may be deformed most seriously when the bolts are tightened, the deformation of the cylinder bore due to the bolt tightening can be suppressed excellently. Therefore, the side face rib of the conventional cylinder block can be eliminated, thereby achieving reduction of the internal combustion engine in weight. Further, because the projection of the suction lateral passage outward can be reduced, the external form of the internal combustion engine can be reduced, thereby improving its loading performance on a vehicle.

According to another aspect of the present invention, a suction vertical passage rising from the cylinder block up to the cylinder head is formed integrally with the rear end side of the suction lateral passage and the top face opening in the cylinder block side of the suction vertical passage and the bottom face opening in the cylinder head side are sealed with a cylinder head gasket at the same time.

Because the suction vertical passage rising from the cylinder block up to the cylinder head is formed integrally with the rear end side of the suction lateral passage and the top face opening in the cylinder block side of the suction vertical passage and the bottom face opening in the cylinder head side are sealed with a cylinder head gasket at the same time, they can be sealed excellently with the cylinder head gaskets, so that the suction vertical passage is formed integrally. Consequently, the stiffness of the cylinder block can be intensified, thereby preventing deformation of the cylinder bore due to the tightening of the bolts.

According to still another aspect of the present invention, an opening communicating with the suction vertical passage and an outlet opening for cooling water which cools the cylinder bores are formed in the rear surface of the cylinder head while a water passage containing a path for connecting the two openings and having an outlet and intake to a heater and an outlet to a radiator is provided so as to cover the rear surface of the cylinder head.

Because the opening communicating with the suction vertical passage and the outlet opening for cooling water which cools the cylinder bores are formed in the rear surface of the cylinder head while the water passage is provided so as to cover the rear surface of the cylinder head, the opening in the rear surface of the cylinder head can be covered excellently by the water passage and further, by installing this water passage, deformation of the cylinder bores in the rear surface at the time of bolt tightening can be suppressed excellently.

According to yet still another aspect of the present invention, the front end side of the suction lateral passage communicates with the water pump provided on the front end side of the cylinder block.

Because the front end side of the suction lateral passage communicates with the water pump provided on the front end side of a cylinder block, by providing the water pump on the front end side of the cylinder block integrally or separately, deformation of the cylinder bores on the front end side at the time of bolt tightening can be suppressed excellently.

DESCRIPTION OF THE PREFERRED EMBODIMENTS

Hereinafter, the preferred embodiments of the present invention will be described with reference to the accompanying drawings.

Figure 1:
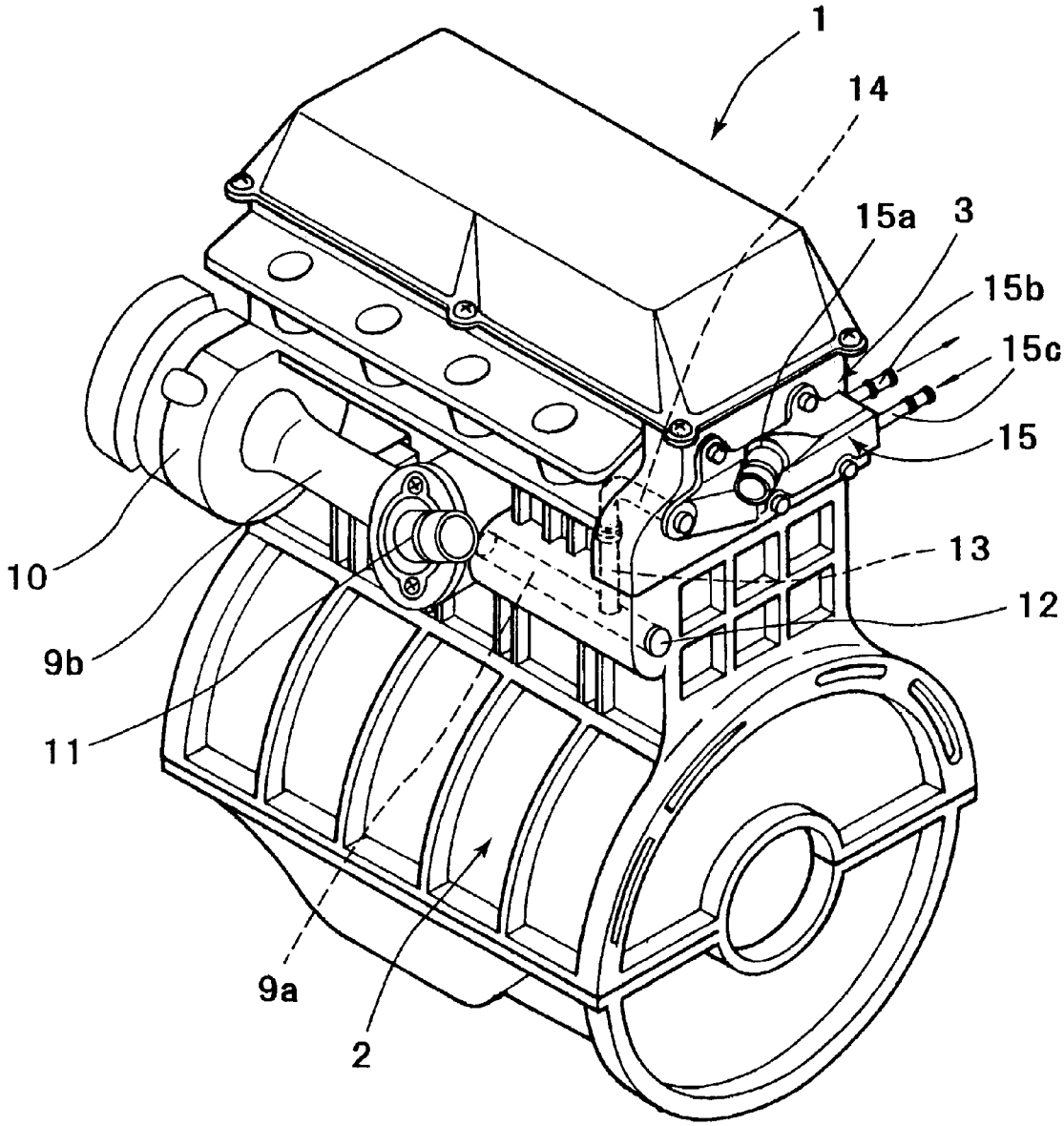
FIG. 1 is an external perspective view of an engine.
Figure 2:
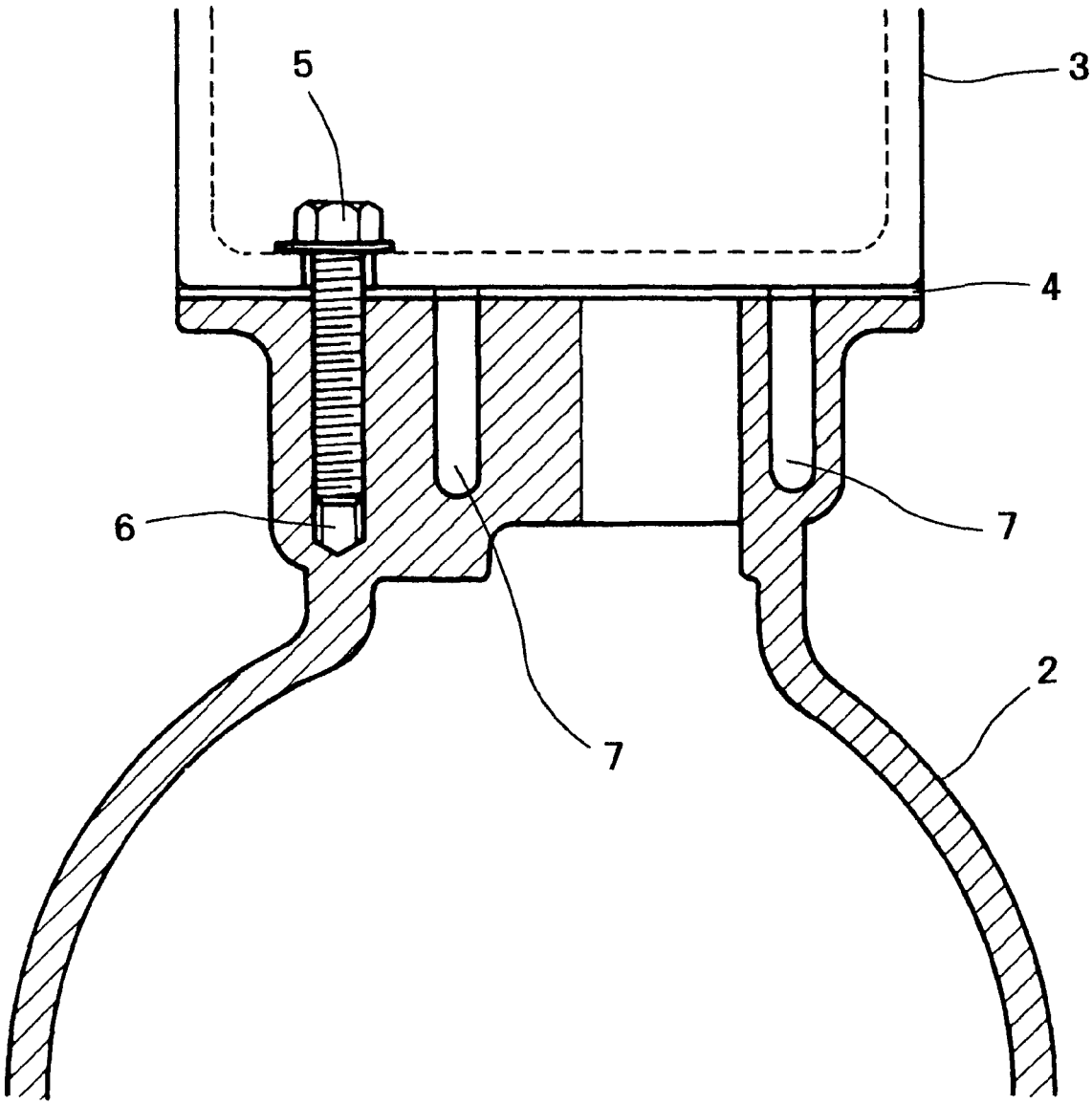
FIG. 2 is a schematic vertical sectional view of a cylinder block and a cylinder head that are coupled with head bolts.

FIG. 1 is an external perspective view of the structure of the engine. In the engine 1, a cylinder head 3 is coupled to the top surface of a cylinder block 2 and as shown by a vertical sectional view of FIG. 2, water jackets 7 in which cooling water passes, are formed in the cylinder block 2 and a bolt hole 6 is formed outside thereof. By tightening head bolts 5 within the bolt hole 6 from above, the cylinder head 3 is tightened on the cylinder block 2 through a cylinder head gasket 4.

Figure 5:
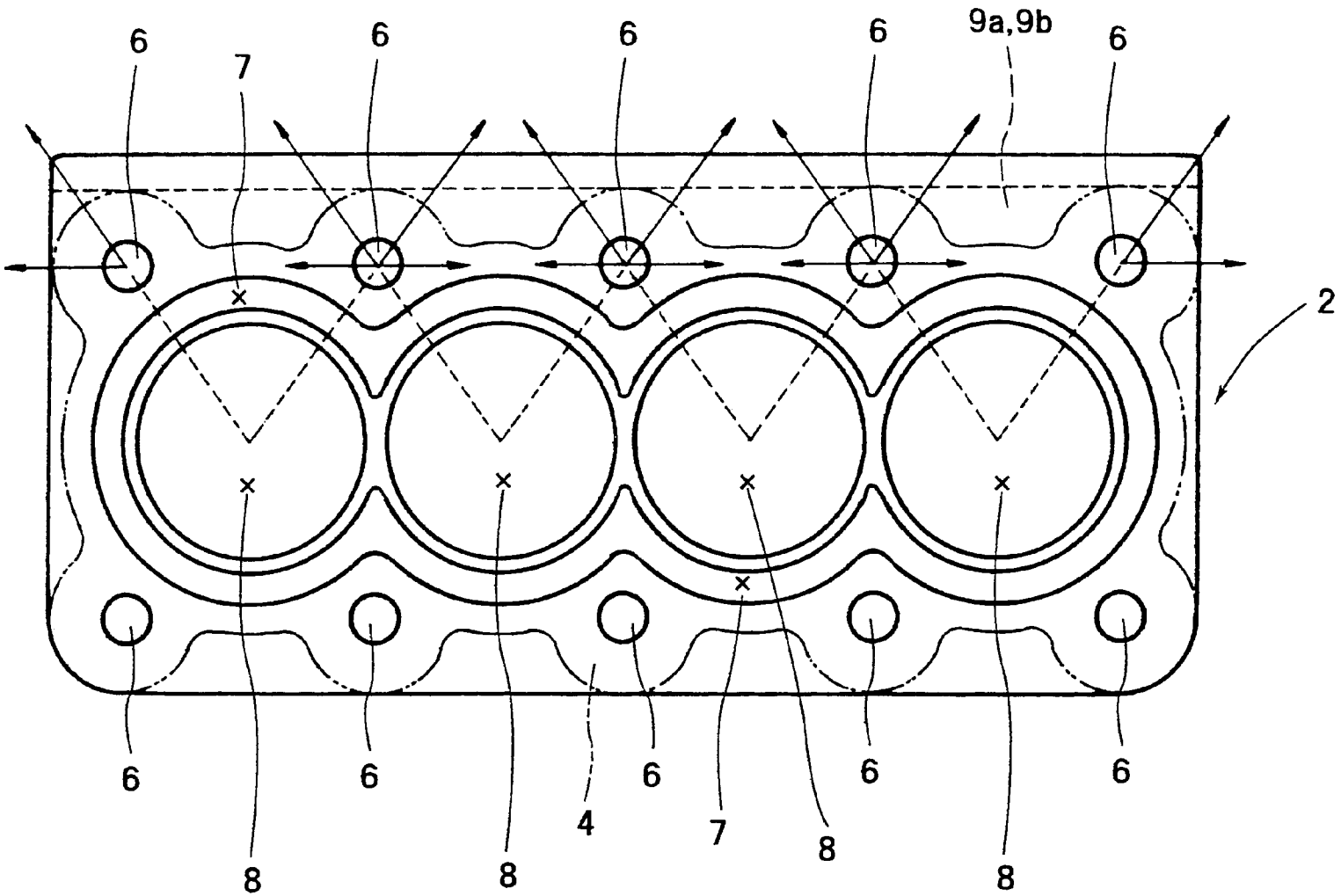
FIG. 5 is an enlarged plan view of the schematic structure of the cylinder block.

That is, as shown with an enlarged plan view of FIG. 5, in this example, the water jacket 7 is formed around four cylinder bores 8 and a plurality of bolt holes 6 are formed outside thereof.

In this example, suction lateral passages 9*a*, 9*b* are formed laterally and integrally with the side face of the cylinder block 2. These suction lateral passages 9*a* are formed integrally with the cylinder block 2 in casting.

Figure 3:
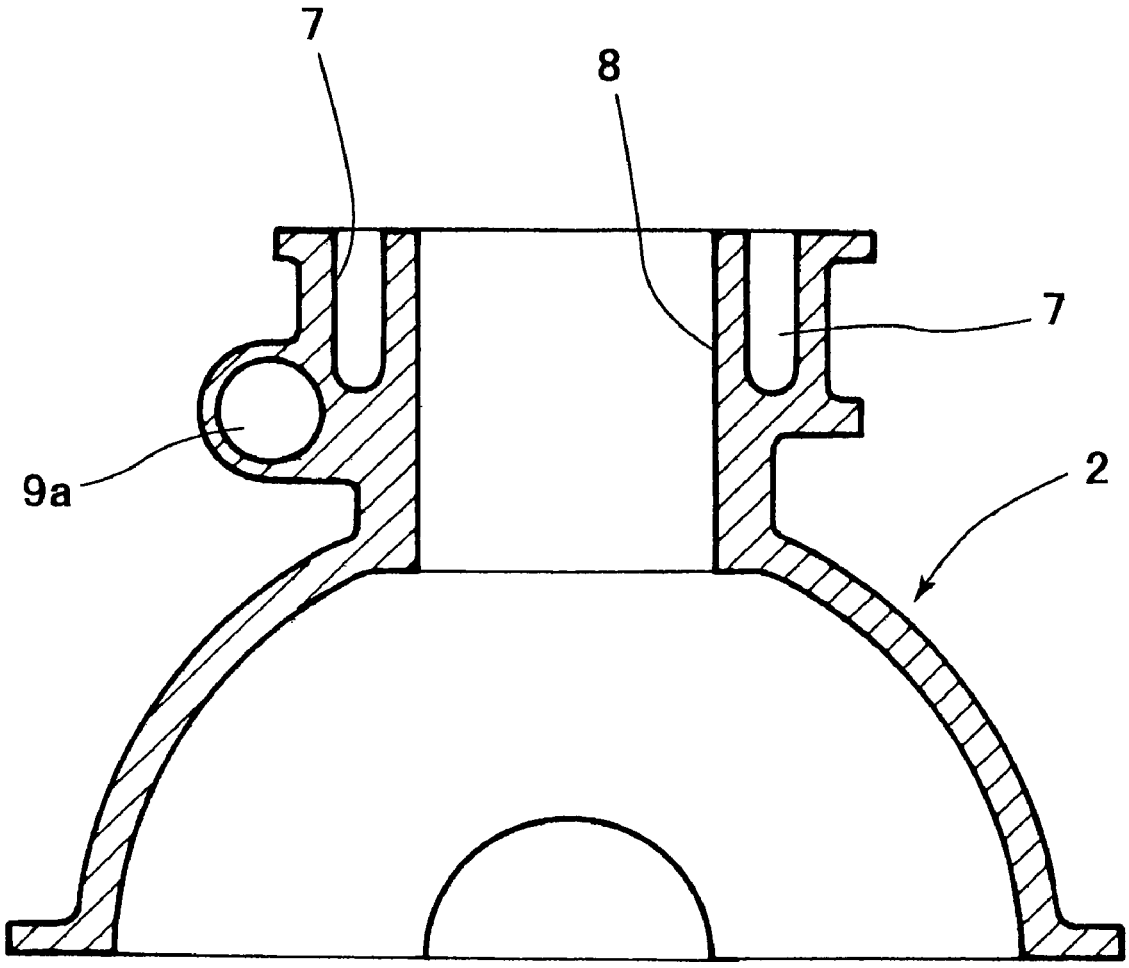
FIG. 3 is an enlarged vertical sectional view of the rear end portion of the cylinder block.
Figure 4:
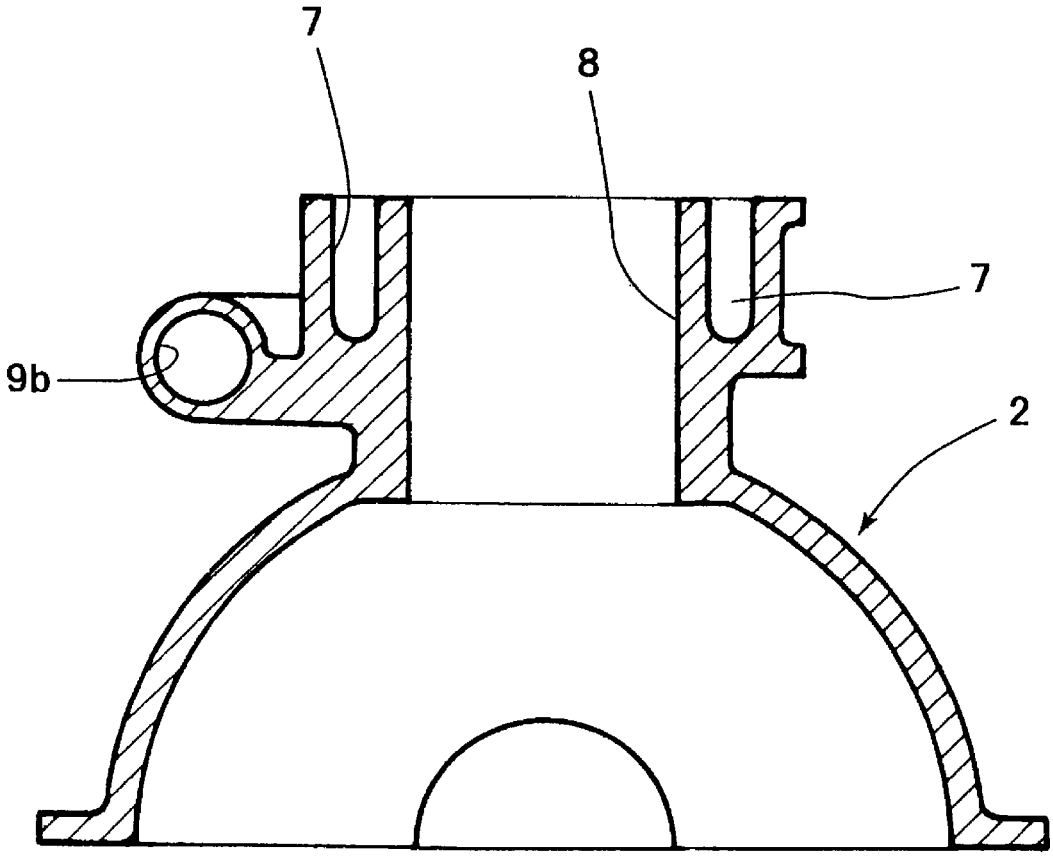
FIG. 4 is an enlarged vertical sectional view of the front end portion of the cylinder block.

FIG. 3 shows a vertical sectional view of the suction lateral passage 9*a* on the read end side. FIG. 4 shows a vertical sectional view of the suction lateral passage 9*b* on the front end side.

The suction lateral passages 9*a*, 9*b* are located outside of the bolt holes 6 and are formed integrally in a lateral direction perpendicular to the bolt holes at a height position in the vicinity of the bottom of the water jacket 7 such that they stride over the a plurality of cylinder bores 8. That is, the suction lateral passages 9*a*, 9*b* are formed in a direction perpendicular to the tightening direction of the head bolt 5.

The rear end of the suction lateral passage 9*a* is open to the rear surface of the cylinder block 2 and a blank plug 12 is attached to this opening in the rear surface.

The suction vertical passage 13 is formed in the front side of the blank plug 12 on the rear end side of the suction lateral passage 9*a* so as to rise from the suction lateral passage 9*a*.

The suction vertical passage 13 is formed so as to rise from the cylinder block 2 to the cylinder head 3, so that it is formed within the cylinder block 2 upward from the suction lateral passage 9*a*. This suction vertical passage 13 is open to the top face of the cylinder block and is formed also vertically in the cylinder head 3, so that it is open to the bottom face of the cylinder head 3.

The top face opening on the side of the cylinder block 2, which constitutes the suction vertical passage 13 and the bottom face opening on the side of the cylinder head 3 match each other and both of them are sealed with the cylinder head gasket 4 at the same time.

A cylinder head internal suction passage 14 is formed within the cylinder head 3 continuously above the suction vertical passage 13 and the cylinder head internal suction passage 14 is open to the rear surface of the cylinder head 3.

A cooling water outlet opening for cooling water which passes through the water jacket 7 so as to cool the cylinder bores 8 is provided in the rear surface of the cylinder head 3 and the cooling water outlet opening and the opening of the cylinder head internal suction passage 14 are covered by a water passage 15 attached to the rear surface of the cylinder head 3.

Within the water passage 15, a passage for connecting the opening of the cylinder head internal suction passage 14 to the cooling water outlet opening is defined and the water passage 15 includes a water outlet 15*a* for sending out cooling water to the side of the radiator. Further, the water passage 15 has an outlet connector 15*b* for sending out cooling water to the side of the heater and an intake connector 15*c* for the flow of the cooling water from the side of the heater.

A water inlet 11 is provided between the suction lateral passage 9*a* and the suction lateral passage 9*b* so as to feed cooling water from the radiator, mixing with cooling water passing through the suction lateral passages 9*a*, 9*b*.

The front end of the suction lateral passage 9*b* is communicated with a water pump housing 10 and the water pump housing 10 is formed integrally with the cylinder block 2. In the meantime, this water pump housing 10 may be provided separately.

Because according to this embodiment, the suction lateral passages 9*a*, 9*b* are formed integrally with the side face of the cylinder block 2, such conventional components as a suction pipe, hose, and hose clip and the like become unnecessary thereby reducing the quantity of necessary components, contributed to less weight and facilitating assembly of components.

Because the suction lateral passages 9*a*, 9*b* are formed perpendicularly to the tightening direction of the head bolt 5, forces for deforming the cylinder bores 8 when the head bolt 5 is tightened act in directions in which they are offset with each other as shown with arrow in FIG. 5, thereby suppressing the deformations of the cylinder bores 8 due to the tightening of the head bolts 5.

Further because the suction vertical passage 13 is provided vertically on the rear end side of the cylinder block 2 and the cylinder head 3 and because the water passage 15 is attached to the rear surface, the deformation of the cylinder bore 8 on the rear end side can be suppressed excellently.

Further because the water pump housing 10 is formed integrally with the front end side of the cylinder block 2, the deformation of the cylinder bore 8 on the front end side can be suppressed by the water pump housing 10.

Particularly when the head bolts 5 are tightened, conventionally, the water jacket 7 is often deformed from the vicinity of the bottom portion thereof so that the roundness of the cylinder bore 8 worsens. However, because the suction lateral passages 9*a*, 9*b* are formed integrally near the bottom portion of the water jacket 7 which is deformed largely in the above case, the deformation generated when the bolts 5 are tightened can be suppressed securely.

Because the deformation can be suppressed excellently in this way, the side face rib of the conventional cylinder block 2 can be reduced, so that the amount of projection out of the suction lateral passages 9*a*, 9*b* can be lessened thereby making it possible to reduce the size of the engine.

What is claimed is:

1. A cooling water passage structure for internal combustion engines having a cylinder block and cylinder bores, comprising:

a water jacket for flowing of cooling water provided on the peripheries of said cylinder bores;

a lateral suction passage integrally formed with a side wall of said cylinder block having bolt holes formed for fastening a cylinder head to said block;

said lateral suction passage passing through said cylinder bores at a height in the vicinity of the water jacket bottom;

said lateral suction passage being arranged on the outside of and perpendicular to said bolt holes;

wherein a suction vertical passage rising from the cylinder block up to the cylinder head is formed integrally with the rear end side of said suction lateral passage and the top face opening on the cylinder block side of the suction vertical passage and the bottom face opening in the cylinder head side are sealed with a cylinder head gasket at the same time; and wherein an opening communicating with said suction vertical passage and an outlet opening for cooling water which cools the cylinder bores is formed in the rear surface of the cylinder head while a water passage containing a path for connecting said two openings and having an outlet and an inlet to a heater and an outlet to a radiator is provided in order to cover the rear surface of the cylinder head.

2. The cooling water passage structure of internal combustion engines according to claim 1 wherein the front and side of said suction lateral passage communicates with a water pump provided on the front end side of the cylinder block.

* * * * *